US009480294B2

(12) United States Patent
Occhipinti

(10) Patent No.: US 9,480,294 B2
(45) Date of Patent: Nov. 1, 2016

(54) MODULAR PROTECTION HELMET

(71) Applicant: Luca Occhipinti, Montescudaio (IT)

(72) Inventor: Luca Occhipinti, Montescudaio (IT)

(73) Assignee: LD PROJECT S.R.L., Cecina (LI) (IT)

( * ) Notice: Subject to any disclaimer, the term of this patent is extended or adjusted under 35 U.S.C. 154(b) by 0 days.

(21) Appl. No.: 14/513,608

(22) Filed: Oct. 14, 2014

(65) Prior Publication Data

US 2015/0101093 A1 Apr. 16, 2015

(30) Foreign Application Priority Data

Oct. 15, 2013 (IT) ..... CO2013A0049

(51) Int. Cl.

| | |
|---|---|
| ***A42B 3/12*** | (2006.01) |
| ***A42B 3/04*** | (2006.01) |
| ***A42B 3/16*** | (2006.01) |
| ***A42B 3/22*** | (2006.01) |
| ***A42B 3/32*** | (2006.01) |
| ***F41H 1/04*** | (2006.01) |
| ***A42B 3/06*** | (2006.01) |

(52) U.S. Cl.

CPC ..... *A42B 3/125* (2013.01); *A42B 3/04* (2013.01); *A42B 3/06* (2013.01); *A42B 3/16* (2013.01); *A42B 3/226* (2013.01); *A42B 3/32* (2013.01); *F41H 1/04* (2013.01)

(58) Field of Classification Search

CPC ..... F41H 1/02; A42B 3/322; A42B 3/00; A42B 3/06; A42B 3/127; A42B 3/105; A42B 1/066; A42B 3/228; A42B 3/04

USPC ..... 2/2.5, 410, 411, 412, 414, 5, 6.1, 6.2, 2/6.4, 909, 422

See application file for complete search history.

(56) References Cited

U.S. PATENT DOCUMENTS

| | | | | |
|---|---|---|---|---|
| 5,940,889 | A * | 8/1999 | Shirai | 2/411 |
| 6,282,726 | B1 | 9/2001 | Noyerie et al. | |
| 6,834,398 | B1 * | 12/2004 | Martinez | 2/424 |
| 8,166,573 | B1 * | 5/2012 | Chung | A42B 3/32 2/411 |
| 9,155,924 | B1 * | 10/2015 | Grove | A62B 18/04 |
| 2003/0070200 | A1 | 4/2003 | Crye et al. | |
| 2006/0277664 | A1 | 12/2006 | Akhtar et al. | |

(Continued)

FOREIGN PATENT DOCUMENTS

| | | |
|---|---|---|
| EP | 0 931 467 A2 | 7/1999 |
| EP | 2 229 830 A1 | 9/2010 |

(Continued)

OTHER PUBLICATIONS

IT Search Report, dated Jun. 18, 2014, from corresponding IT application.

*Primary Examiner* — Tejash Patel

(74) *Attorney, Agent, or Firm* — Young & Thompson

(57) ABSTRACT

A modular protection helmet (1; 1A) has an internal cap (2) including a padding layer (6) and modular components at will, and including an external cap (3) which can be removably and interchangeably fixed to the internal cap (2) and adapted to provide the desired protection level for civil use, and preferably the helmet includes a second external cap (3A), which can be equally removably and interchangeably fixed to the internal cap (2) and adapted to provide a ballistic protection level, wherein the first (3) and second (3A) external caps can be replaced at will by the user as a function of the use from time to time intended for the helmet through removable coupling elements (10, 11).

14 Claims, 6 Drawing Sheets

(56) References Cited

U.S. PATENT DOCUMENTS

| | | | | |
|---|---|---|---|---|
| 2007/0056071 | A1 | 3/2007 | Smith | |
| 2007/0083967 | A1 | 4/2007 | Crossman et al. | |
| 2012/0011631 | A1 | 1/2012 | Crossman et al. | |
| 2012/0167268 | A1* | 7/2012 | Crye et al. | 2/6.6 |

FOREIGN PATENT DOCUMENTS

| | | | |
|---|---|---|---|
| WO | 2005/120265 | A1 | 12/2005 |
| WO | 2010/149878 | A1 | 12/2010 |
| WO | 2013/057745 | A1 | 10/2011 |

* cited by examiner

MODULAR PROTECTION HELMET

FIELD OF APPLICATION

The present invention refers to a modular protection helmet according to the preamble of claim 1.

TECHNOLOGICAL BACKGROUND AND STATE OF THE ART

As known, helmets serve to protect the head of the user against impacts and knocks that may occur during sports activities, such as for example car racing, motorcycle racing, skiing, etc. or the so-called civil interventions, like in the case of fire fighters, health workers on ambulances etc, wherein the mechanical and functional resistance characteristics must meet the required standards for the respective approval.

In the current helmets it is known to provide for modular construction methods which allow the application or removal of parts or components of the helmet. Examples of execution of helmets of the prior art are observable for example from various documents.

Document WO2010149878 A1 discloses an interchangeable external cap, in particular for motorcycle helmets, wherein said external cap is made up of two parts fixed to each other, one of which, i.e. the main cap absorbs and reduces effects in case of a fall and impact, while the second which is in the nape area is only designed for aesthetic purposes and helmet graphic customisation.

Document EP0931467A3 discloses a helmet with a separable external cap provided with through ventilation openings over an internal cap of the helmet, equally provided with cavities for ventilation purposes, for example for cyclists, wherein said caps are equally designed for helmet customisation.

Document EP2229830 B1 illustrates a helmet having a separable external cap, which constitutes an aesthetic and non-structural cap, thus especially made for aesthetic graphic helmet customisation purposes.

Document US2003070200 A1 discloses a ballistic military helmet, in which the base is a ballistic cap to which there are internally applied comfort linings, while the external has a cover made of camouflage fabric or the like.

Document WO2013057745 A1 discloses a multifunctional public order protection helmet, whose distinctive characteristic lies in the integrated arrangement of a Bluetooth sound system.

Document U.S. Pat. No. 6,282,726 B1 illustrates a fire fighter helmet in which there are provided two visors which rotate internally and are hinged concentrically.

In the known helmets there are provided separable parts, displaceable or integrated for customisation purposes or improving the use conditions helmets, but which do not regard parts modifying the protection level of the helmet.

It is observed that in military applications the so-called ballistic helmet was conceived for protecting the head of the user against direct and indirect impacts of bullets or fragments thereof.

The inventor observed that in the aeronautic industry, and in particular helicopter operators, the personnel uses helmets without any type of ballistic protection, made of plastic or composite material and solely aimed at providing protection against accidental impacts and incorporate an inter-sound communication system with a high soundproof degree.

In addition, it is known that the new operating interventions that are to be carried out with aircrafts have required the use of ballistic protections both for the transported personnel and especially for the crew actively taking part in the missions.

Currently, ballistic elements are exclusively used by ground personnel, and cannot be used for aeronautic purposes, due to the fact that these helmets, due to their weight, design and soundproof ability, are not applicable to aircrafts.

In addition, it is known that the current ballistic helmets, made using high resistance fibres such as DYNEMA, KEVLAR, etc. have relatively short life/use cycles (having a not more than 5-year expiry) hence the administrations managing these ballistic helmets have to constantly request them hence implying high costs.

A further disadvantage of the current helmets lies in the fact that they are not adaptable in their protection level to the type of threat to be expected and thus not lead to the user carrying the weight on the head even when not necessary.

SUMMARY OF THE INVENTION

The present invention has the task of providing a modular protection helmet capable of overcoming the limits and drawbacks of the helmets of the prior art. As regards the protection level, the task of providing the protection level required by the expected use from time to time falls within the task of the invention.

The indicated task is attained, according to the invention, by an integral modular protection helmet having the characteristics of claim 1.

Further advantageous embodiments can be observed from the dependent claims.

Various and important advantages are attained through the modular protection helmets according to the invention.

Firstly, the proposed helmets are provided for advantageous application not only in the aeronautic, defence and anti-riot sectors but also in the safety for, for example, traffic police, fire fighters, police forces, civil protection rescue operators and so on and so forth, wherein in a preferred embodiment there are advantageously provided two types of interchangeable external caps, and more precisely a lighter base cap with degree of protection for civil use and a heavier ballistic cap for "military" uses.

In a first embodiment with only one protection level, for example with "ballistic" cap, the proposed helmet allows using and further maintaining the internal cap even in case of replacing the external protection cap following deterioration thereof over time, with ensuing considerable saving both from an economic and material point of view.

In a further preferred embodiment, providing for a single internal cap and two external caps with two different protection levels, i.e. with a base cap and ballistic cap, shall practically provide for a helmet allowing both civil and military use, hence "merging" two helmets into only one helmet. Thus, this helmet may be adapted daily, i.e. at will, to one need or the other (civil or military use), for example for training (by applying the lighter base cap) or for military use (by applying the heavier ballistic cap), as occurs, for example, in the helicopter operator sector.

Actually, for example, the helicopter crew in an operation requires a flight helmet with suitable ballistic protection (according to the threat level), while the same crew does not require ballistic protection (which would imply an increase of weight to be borne, useless) but just a protection against accidental events, wherein said replacement is now obtainable following the interchangeability of the external caps.

In addition, such interchangeability can be obtained simply by using known means or fixing systems, i.e. coupling/ de-coupling, removable and, preferably, with fastening means (screws and holder nuts), that are easy and inexpensive to make and easy to handle.

The helmets according to the invention are also distinguished for their modularity for the single components provided for, in particular in the aircraft industry. Actually, various aircrafts install different communication systems, with different audio characteristics with respect to each other, hence the administration is required to adapt every aircraft to a type of helmet all the time, wherein the applied modifications are poorly functional at times.

Advantageously, the two external caps or base and ballistic cover practically differ geometrically just in terms of the thickness of the ballistic cover with respect to the thickness of the base cover, and given that the two basic and ballistic covers are exactly interchangeable with respect to each other, said interchangeability is advantageously obtained without the use of intermediate components and using the same fixing means on the internal cap without any further use manufacturing of additional components. A further advantage of the interchangeable external caps lies in the fact that the removal/application thereof occurs within a short period of time and definitely acceptable for practical use even in emergency cases.

The economic advantage of the two-functional helmet according to the invention is even more evident for a simplified storage of the base helmets as well as base and ballistic covers, which, as known, may be replaced indistinctively and periodically within a few years. Saving in terms of storage of internal and external caps would actually amount to 50% with respect to using, as currently usually done, conventional helmets with just one base or ballistic cap.

A further advantage of the helmets according to the invention, in particular of the multifunction type, lies in the fact that they are adapted to provide maximum comfort to the user simultaneously guaranteeing a complete protection against impacts and knocks with maximum use flexibility.

BRIEF DESCRIPTION OF THE DRAWINGS

Further characteristics, advantages and details of the modular protection helmets according to the invention shall be more apparent from the following description of three preferred embodiments, illustrated schematically in the attached drawings, wherein.

DESCRIPTION OF THE PREFERRED EMBODIMENTS

Figure 1:
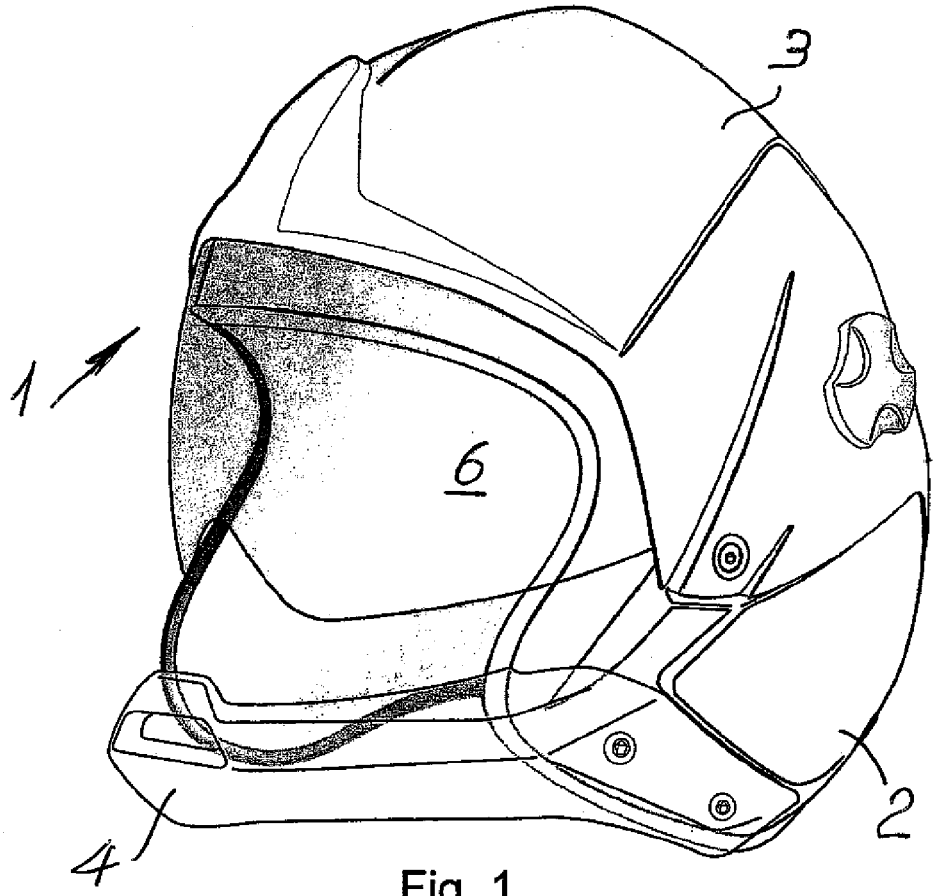
FIG. 1 shows a front perspective view of a helmet having an internal cap and a cover or external base cap.
Figure 2:
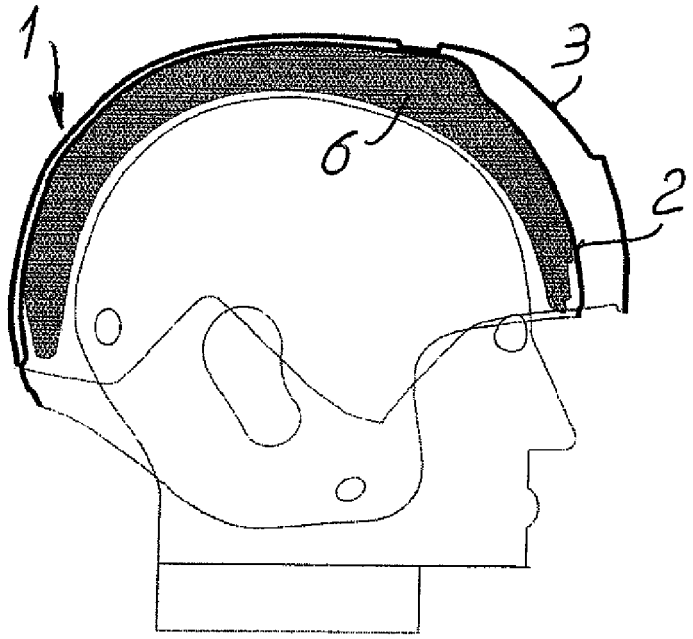
FIG. 2 shows a median longitudinal section of the helmet of FIG. 1.
Figure 3:
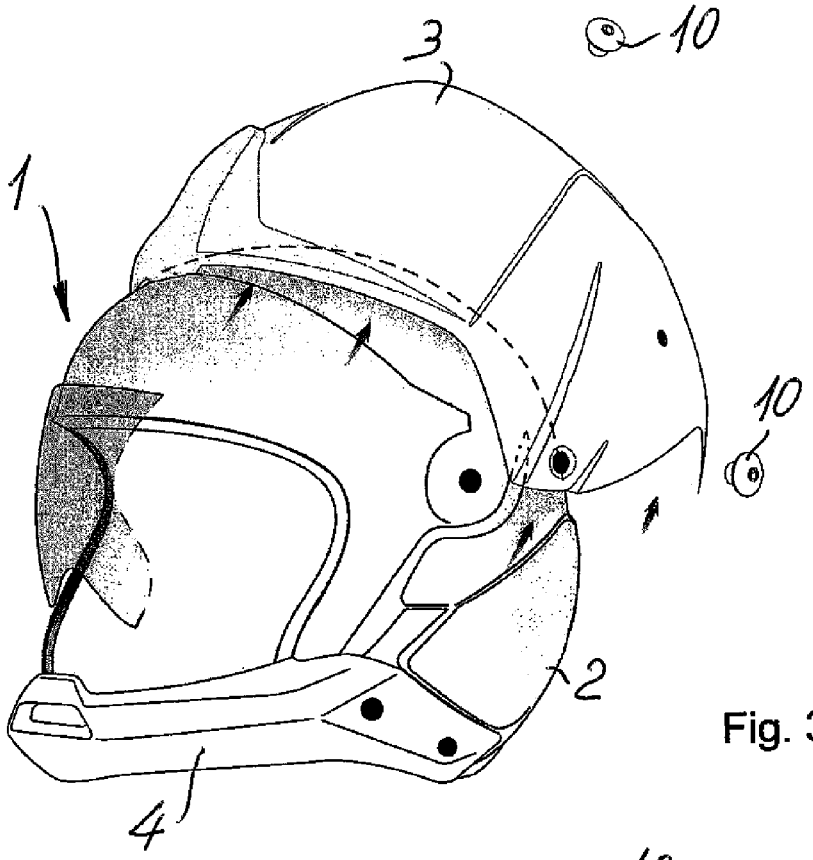
FIG. 3 shows a perspective view of the helmet of FIG. 1 with base cover during an initial stage of removal from the internal cap.
Figure 4:
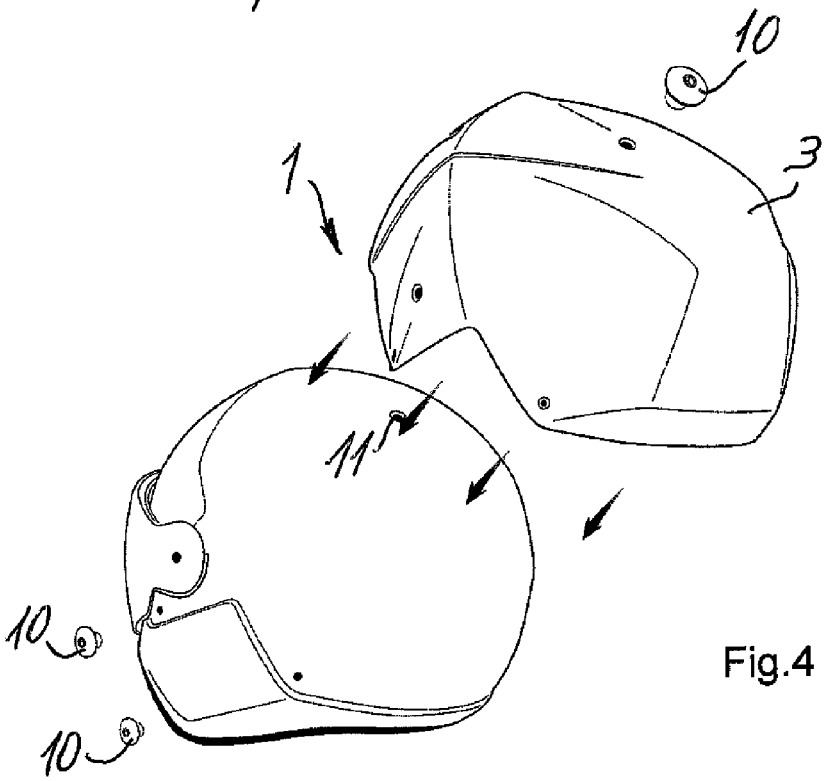
FIG. 4 shows a top perspective view illustrating a step of applying the base cap to the internal cap for the relative assembly.

First, reference is made to FIGS. 1 to 4 illustrating a first modular helmet indicated in its entirety with 1 and substantially formed by an internal cap 2 and a cap or base external cover 3, i.e. of the "light" type adapted for civil operations, wherein the internal cap 2 may have, at will, interchangeable modular components, such as for example a chin support 4, as well as an acoustic module 5 (FIG. 6), two visors 7, 8 hinged in 9 (FIG. 5), as well as cheek protections, a nape guard and so on and so forth, not illustrated better.

The various modular components may be removably fixed in the/on the internal cap 2 with padding 6 using known coupling/decoupling or fixing means, also not illustrated better.

In the illustrated helmet 1 the coupling/decoupling or fixing means between the internal cap 2 and external cap 3 may advantageously be formed according to the invention by simple screws 10 and holder nuts 11 in the internal cap 2 that are quick and easy to handle, alternatively to the known coupling and separation means.

Figure 5:
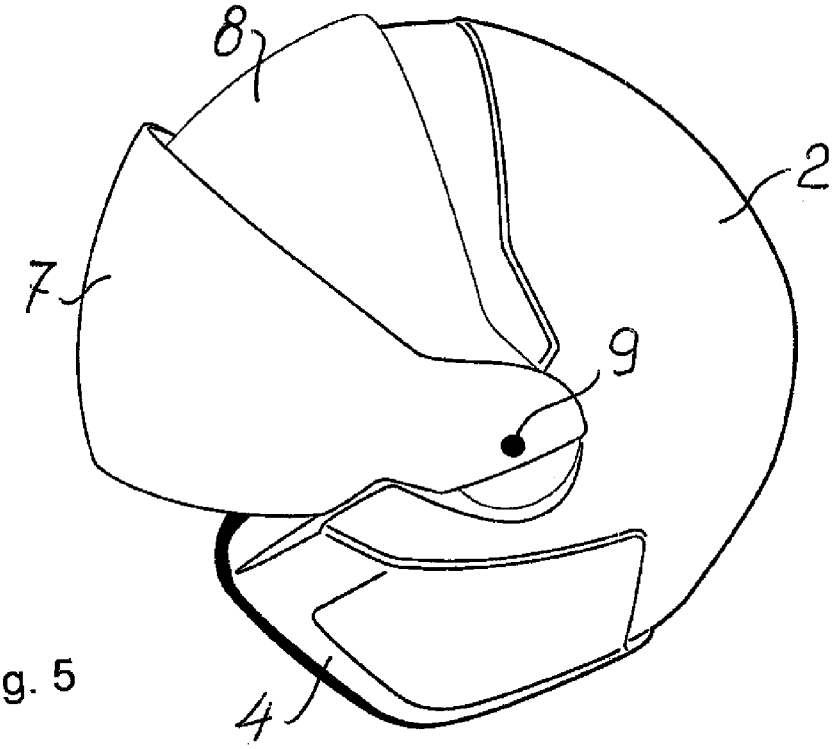
FIG. 5 shows a perspective view of an internal cap provided with two concentric visors and a chin support element.

By way of example, as illustrated in FIG. 5, the internal cap 2 has an embodiment with two visors 7, 8, hinged in 9, wherein one visor is transparent or "CLEAR" and the other is of dark type or "DARK" and they may be used both singularly and simultaneously.

Figure 6:
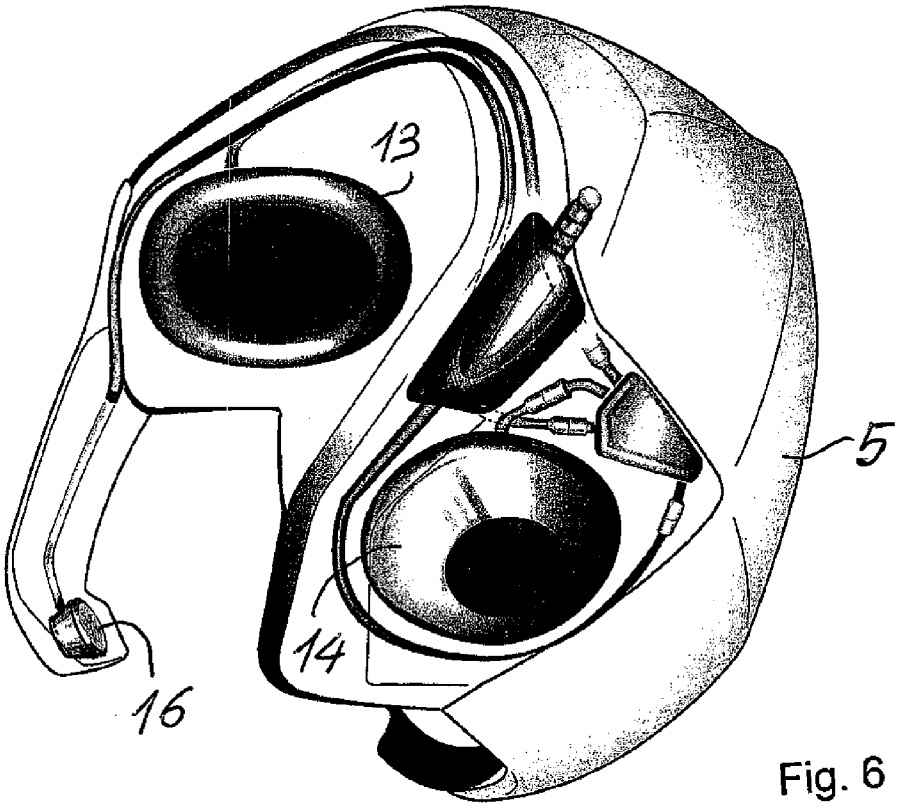
FIG. 6 shows a view on a modular acoustic module, which can be housed in an interchangeable manner in the internal cap, FIGS. 7, 8, 9 and 10 respectively correspond to FIGS. 1 to 4 and they illustrate a second modular protection helmet, wherein the only difference with respect to the helmet of FIGS. 1-4 with cap or base cover lies in that in the example illustrated in FIGS. 7 to 10 the cover or external cap is a ballistic cover, whose graphic representation in FIG. 8 has a greater line thickness with respect to that of the base cover illustrated in FIG. 2.
Figure 7:
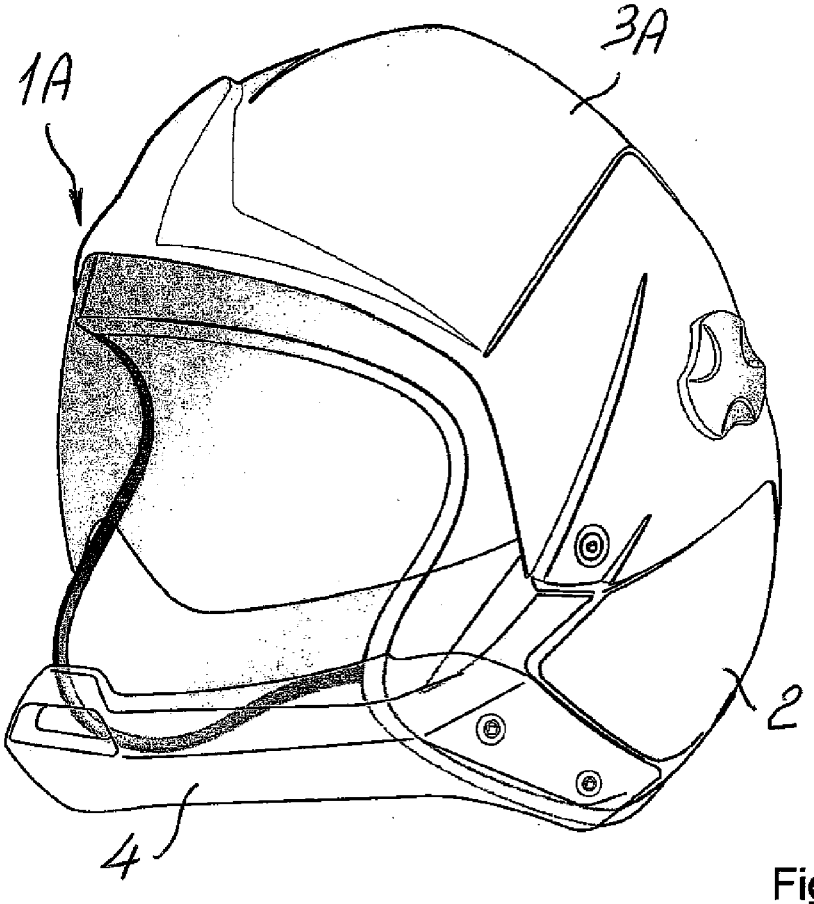
Figure 8:
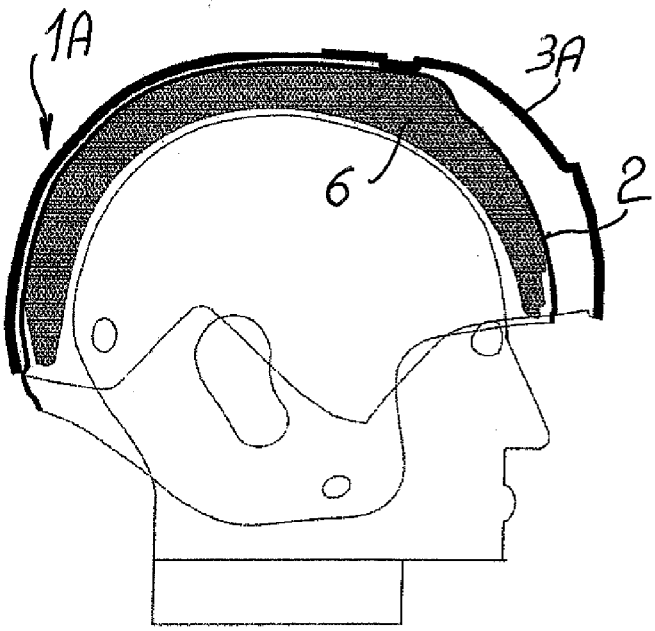
Figure 9:
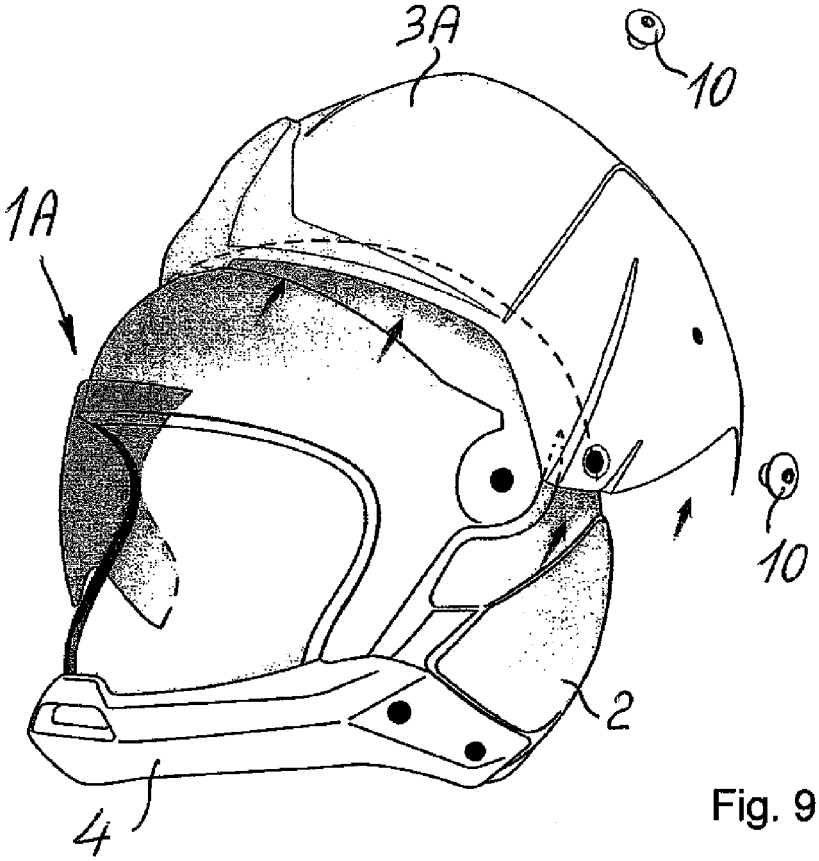
Figure 10:
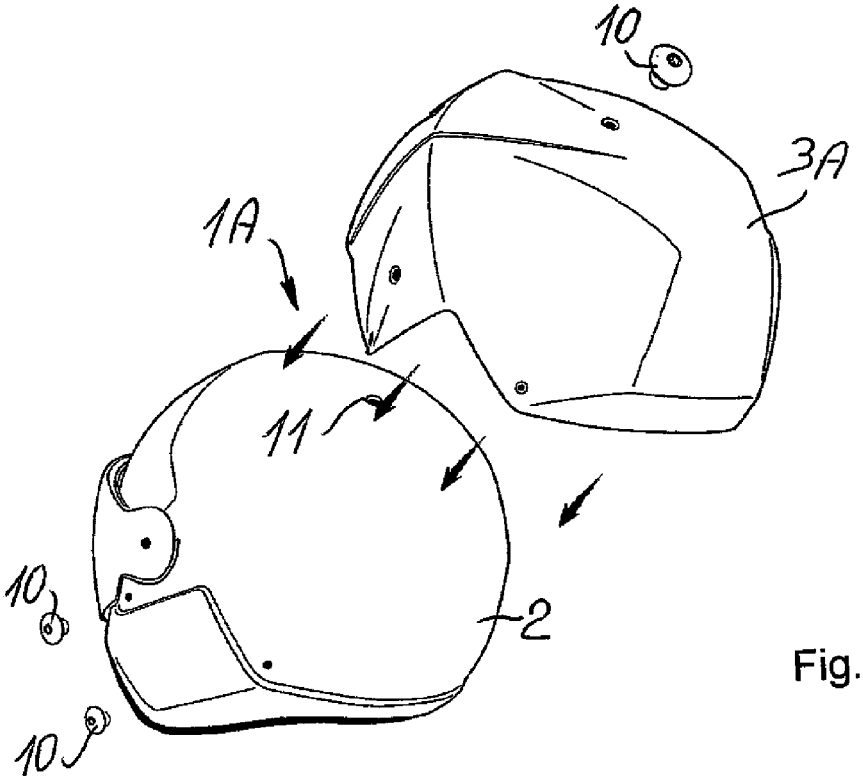

There is also provided an acoustic module 11 as illustrated in FIG. 6, for example for helicopter operators.

Now reference shall be made to the modular protection helmet 1A illustrated in FIGS. 7 to 10, wherein the only difference with respect to the modular protection helmet 1 illustrated in FIGS. 1 to 6 consists in the use of a heavier cap or external ballistic cover 3A, i.e. of the ballistic type, wherein the internal cap 2 is practically the same illustrated further above in FIGS. 1-4, thus the same reference numbers are used.

Figure 11:
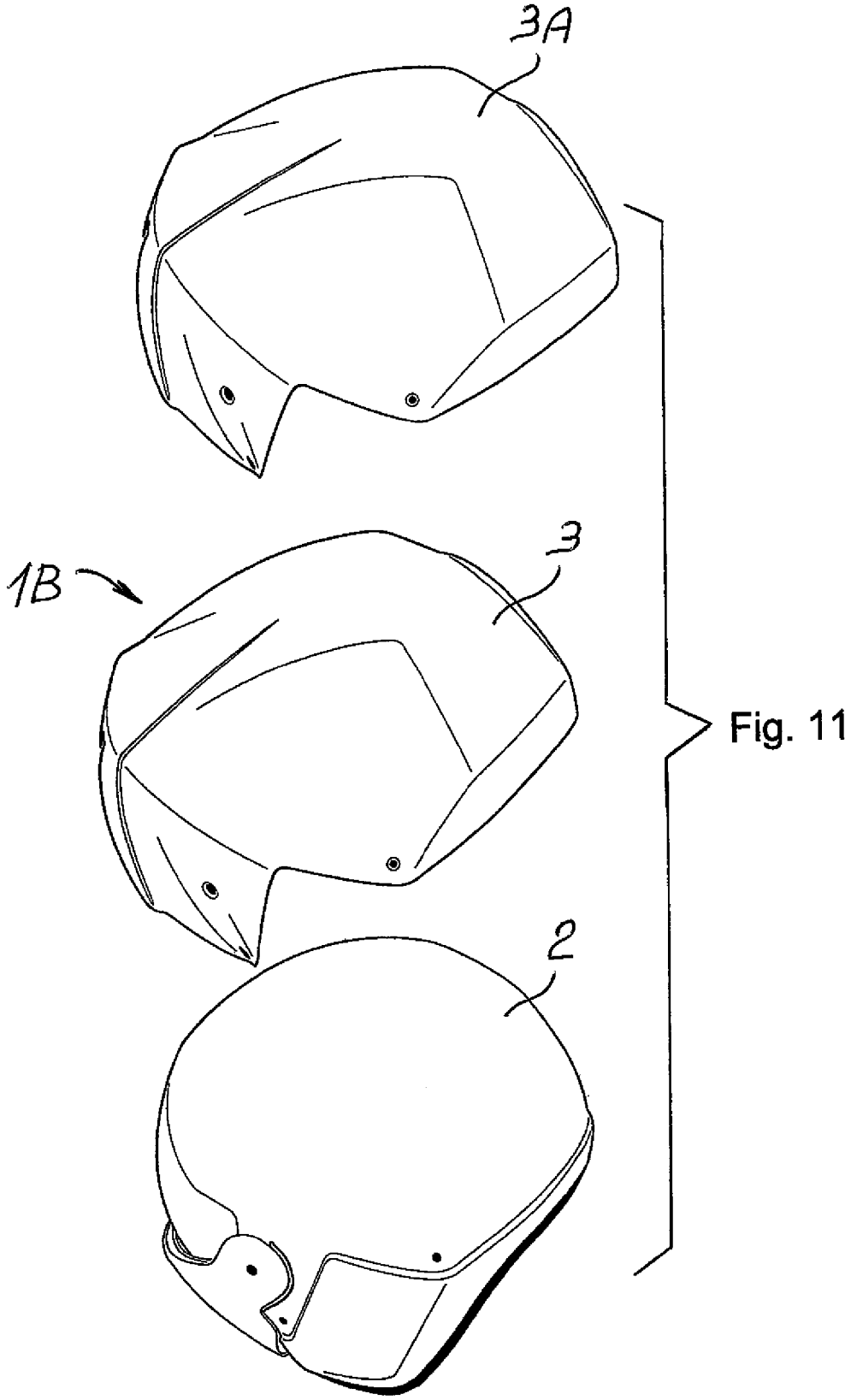
FIG. 11 illustrates, in an exploded top perspective view, a third preferred embodiment of a multifunction modular protection helmet with two protection levels.

Now, reference shall be made to FIG. 11 which illustrates a further modular protection helmet 1B according to a further teaching of the invention.

According to this teaching, the helmet 1B is constituted by an internal cap 2, as illustrated further above, and it is provided with a lighter base cap 3, for civil interventions, same case applying to the heavier ballistic cap 3A, for anti-riot interventions or for military operations, as described in the introduction.

This base teaching may be practically obtained using internal caps 2 of the desired shape and with the base cap 3 and ballistic cap 3A matching in the geometric embodiment and not that of the internal cap 2.

The method of use of the helmets 1, 1A and 1B according to the invention are easily observable form the description above.

As regards helmets 1 and 1A the external cap 3 and 3A may be left on the internal cap 2 up to the replacement of the external cap 3 and 3A deterioration over time. In this case, upon replacing the internal cap 2 it shall be maintained and used further, indistinctively using a new external cap 3 or 3A.

For these helmets 1 and 1A there is also the possibility of purchasing in additionally to the external cap of the helmet, for example the external cap 3 or an additional external cap 3A, or vice versa, hence obtaining a plurality of advantages for the helmet 1B, which can thus be used as follows: usually on the internal cap 2 there is applied the external cap used more frequently, for example a base cap 3 for training, for example for helicopter operators. The helmet 1B will thus be usually and repeatedly used for training activities following each other.

In case of an operation or military action, from the internal cap 2 there shall be removed the base cap 3 and replaced by a ballistic cap 3A. The operations of removing the base cap 3 and applying the ballistic cap 3A shall occur rapidly, for example by removing and fastening the assembly screws 10 in the relative holder nuts 11 in the internal cap 2.

Upon terminating the military operation it will be sufficient to replace the ballistic cap 3A with the base cap 3 to use the helmet 1B in its light training version.

As concerns the resistance characteristics of the base cap and the ballistic caps used, the same shall obviously meet the various approval requirements of the single sectors and specific activities, as well known to a man skilled in the art.

Analogously, in the internal cap 2 there may be provided modules of various components at will, as provided for by the single sectors of use.

By way of example there are also provided the following technical preferred details.

The base helmet is made of carbon fibre and Kevlar™ so as to meet the required mechanical resistance characteristics, and its main functions and technical features are as follows:

- housing the protection cap made of expanded polystyrene, participate in absorbing uncontrolled impacts,
- housing the predispositions for communication audio system,
- housing 2 protection visors,
- removably housing the cap or external cover (base or ballistic),
- housing removable goggles of the "LOW PROFILE" type,
- housing the maxillofacial protection,
- housing the sound kit module.

The internal housing is made of expanded polyurethane and it is adapted to guarantee suitable comfort for the user and coated with fireproof material and it can be replaced and washed.

The external base cap is capable of:

- absorbing uncontrolled impacts and it is resistant to perforations,
- being balanced and simultaneously allow balancing the helmet on the head,
- guarantee support to the night vision systems,
- protecting the two visors.

The external ballistic cap protects the head of the user against direct and indirect impacts of shrapnel or bullet fragments, and it is capable of:

- absorbing uncontrolled impacts and it is resistant to perforations,
- being balanced and simultaneously allow balancing the helmet on the head,
- guarantee support to the night vision systems,
- protecting the two visors.

The maxillofacial protection 4 can be removably applied to the internal cap 2, it can be actuated using both hands and it is perfectly integrated both with the visors and with removable goggles of the "LOW PROFILE" type. The modular sound kit module is adapted to guarantee the acoustic insulation with the external environment and it has components (modular earphone cups and demountable singularly with "Fast Plug" connection, removable modular microphone with "FAST PLUG" connection) also completely removable to facilitate replacement thereof in case of damage or a technological upgrade of the system. In addition, the helmet is predisposed for the installation of an acoustic protection of the CEP type and an audio output for recording communications.

From the outlined structural and functional description of the modular helmets with base or ballistic cover or of the bivalent type according to the invention it is easily observable that the same allows efficiently overcoming the indicated task and it allows obtaining the mentioned advantages.

In practice those skilled in the art may introduce modifications of variants of the internal cap as well as the base and external ballistic caps, same case applying to replacing the single modular components provided with the others, such as for example the sound kit module, chin support and different visors, or provide for accessories or completion modules, such as for example the under-throat element, nape guard and the like, without departing from the scope of the present invention as described and claimed.

The invention claimed is:

1. A modular protection helmet comprising:

an internal wearable cap (2) comprising a padding layer;

modular components removably fixed to the internal wearable cap (2);

first coupling means provided on the internal wearable cap (2);

a first external cap (3) that, using the first coupling means, mounts to the internal wearable cap (2) to provide a first protection level for civil use including for training helicopter operators; and a second external cap (3A) that, using the first coupling means, mounts to the internal wearable cap (2), as an alternative to the first external cap (3), to providing a second protection level that provides a ballistic/military protection level, wherein the second protection level is greater than the first protection level, wherein, apart from differing in thickness, the first and second externals caps (3, 3A) having a same geometrical and dimensional conformation, and wherein each of said first and second external caps (3, 3A) mount alternatively, at will by a user, on said internal wearable cap (2) in an interchangeable way, based on a function of intended use of the helmet, free of any use of intermediate components and using the first coupling means provided on the internal wearable cap (2).

2. The modular protection helmet according to claim 1, wherein said modules components are fixed to the internal wearable cap (2) with second coupling means.

3. The modular protection helmet according to claim 1, wherein said first coupling means are constituted by fastening means (10, 11).

4. The modular protection helmet according to claim 1, wherein the helmet (1A, 1B) further comprises a removable modular sound kit (5) providing an acoustic insulation with an external environment and comprising earphone cups (13, 14) made of composite modular material and demountable singularly with a "Fast Plug" connection, and a removable modular adjustable microphone (16) with "Fast Plug" connection, wherein the helmet (1A; 1B) is predisposed for the installation of an acoustic protection of the CEP type and an audio plug for recording communications.

5. The modular protection helmet according to claim 1, wherein the helmet (1; 1A; 1B) is provided with two removable protection visors (7; 8), a transparent or "CLEAR" and a dark type or "DARK" one, which can be used both singularly and simultaneously.

6. The modular protection helmet according to claim 1, wherein the helmet is provided with removable protective goggles of the "LOW PROFILE" type.

7. The modular protection helmet according to claim 1, wherein the helmet (1; 1A; 1B) is provided with a removable maxillofacial protection (4).

8. The modular protection helmet according to claim 1, wherein the helmet (1; 1A; 1B) is provided with a removable nape guard.

9. The modular protection helmet according to claim 1, wherein said first coupling means are constituted by screws (10) that pass through the first and second external caps (3, 3A) and holder nuts (11) in the internal wearable cap (2).

10. A modular protection helmet comprising:

an external cap (3);

an internal wearable cap (2) comprising a padding layer, the external cap (3) being removable with respect to the internal wearable cap (2);

modular components removably fixed to the internal wearable cap;

coupling elements (10, 11) that removably fix the modular components to the internal wearable cap (2); and a removable modular sound kit (5) that provides an acoustic insulation with an external environment, the removable modular sound kit (5) comprising i) earphone cups (13, 14) made of composite modular material and demountable singularly with a fast plug connection, and ii) a removable modular adjustable microphone (16) with another fast plug connection, wherein the helmet (1A; 1B) is predisposed for the installation of a CEP type acoustic protection and an audio plug for recording communications.

11. A modular protection helmet, comprising:

an internal wearable cap (2) comprising a padding layer;

modular components removably fixed to the internal wearable cap (2);

coupling elements;

a first external cap (3) that, in a first configuration and using the coupling elements, removable mounts to the internal wearable cap (2) to provide a first protection level wherein in the first configuration, the second external cap is not mounted to the internal wearable cap;

a second external cap (3A) that, in a second configuration and using the coupling elements, removable mounts to the internal wearable cap (2), as an alternative to the first external cap (3), to providing a second protection level, wherein in the second configuration the first external cap is not mounted to the internal wearable cap, wherein the second protection level is greater than the first protection level, and wherein each of said first and second external caps (3, 3A), using the coupling elements, mount alternatively directly on said internal wearable cap (2) in an interchangeable manner.

12. The modular protection helmet according to claim 11, wherein the first and second externals caps (3, 3A) differ geometrical only as to thickness.

13. The modular protection helmet according to claim 11, wherein said coupling elements comprise screws (10) that pass through the first and second external caps (3, 3A) and holder nuts (11) in the internal wearable cap (2).

14. The modular protection helmet according to claim 12, wherein said coupling elements comprise screws (10) that pass through the first and second external caps (3, 3A) and holder nuts (11) in the internal wearable cap (2).

* * * * *